US005851138A

United States Patent [19]

Hempel, Jr.

[11] Patent Number: 5,851,138

[45] Date of Patent: Dec. 22, 1998

[54] POLISHING PAD CONDITIONING SYSTEM AND METHOD

[75] Inventor: Eugene O. Hempel, Jr., Garland, Tex.

[73] Assignee: Texas Instruments Incorporated, Dallas, Tex.

[21] Appl. No.: 906,584

[22] Filed: Aug. 5, 1997

Related U.S. Application Data

[60] Provisional application No. 60/023,956, Aug. 15, 1996.

[51] Int. Cl.[6] ..... B24B 53/00

[52] U.S. Cl. ..... 451/56; 451/443

[58] Field of Search ..... 451/56, 41, 72, 451/443, 444; 407/61, 103, 119, 62, 53

[56] References Cited

U.S. PATENT DOCUMENTS

| | | | |
|---|---|---|---|
| 4,743,144 | 5/1988 | Shikata | 407/62 |
| 5,188,489 | 2/1993 | Santhanam et al. | 407/119 |
| 5,216,843 | 6/1993 | Breivogel et al. | 451/56 |
| 5,486,131 | 1/1996 | Cesna et al. | 451/56 |
| 5,547,417 | 8/1996 | Breivogel et al. | 451/56 |
| 5,569,062 | 10/1996 | Karlsrud | 451/56 |
| 5,626,509 | 5/1997 | Hayashi | 451/56 |

*Primary Examiner*—Robert A. Rose
*Attorney, Agent, or Firm*—W. James Brady, III; Richard L. Donaldson

[57] ABSTRACT

A system and method for conditioning a polishing pad[12] in a chemical-mechanical polishing process for polishing a semiconductor wafer. The conditioning system includes a conditioning device 20 into which a plurality of removable inserts 24 are inserted. The inserts each have a tip 26 comprising a conditioning material. During operation, the plurality of insert tips 26 contact the polishing pad 12 to condition the polishing pad 12, thereby enhancing the uniformity of wafers polished by the polishing pad and reducing damage to polished wafers.

17 Claims, 3 Drawing Sheets

POLISHING PAD CONDITIONING SYSTEM AND METHOD

This application is a provisional of Ser. No. 60/023,956 filed Aug. 15, 1996.

TECHNICAL FIELD OF THE INVENTION

The present invention relates to semiconductor device processing and, more particularly, to a system and method for conditioning a semiconductor wafer polishing pad that utilizes titanium nitride silicon carbide tipped inserts to enhance pad conditioning.

BACKGROUND OF THE INVENTION

Advances in electronic devices generally include reducing the size of the components that form integrated circuits. With smaller circuit components, the value of each unit area of a semiconductor wafer becomes higher. The planarization, contaminant count, and general uniformity of a semiconductor wafer become critical to achieving this reduction in size of integrated circuits and enhancing the performance of these integrated circuit devices.

In order to planarize a semiconductor wafer and to remove particle contaminants, many wafer manufacturer employ chemical mechanical polishing ("CMP") processes. CMP systems place a semiconductor wafer in contact with a polishing pad that rotates relative to the semiconductor wafer. The CMP process will reduce voids in the wafer, increase the flatness of the wafer, and generally will enhance the performance of the integrated circuit. To enhance the effectiveness and the life of the polishing pad, CMP systems typically employ a pad conditioning system to condition the polishing pad to enhance the removal rate and the planarization of the wafer.

Conventional pad conditioning systems typically employ a conditioning disk, for example a diamond impregnated conditioning disk, for conditioning the polishing pad. The conditioning disk substrate, typically stainless steel or brass, can contain a semiuniform distribution of diamonds impregnated on the conditioning surface of the conditioning disk. The diamonds are typically held onto the conditioning disk by embedding them in an electroless nickel plating that attaches to the conditioning disk substrate. These conventional pad conditioning systems have several limitation.

In the diamond impregnated disks, the diamonds can break away from the nickel plating and fall out onto the polishing pad. Due to either diamond fallout, or merely diamonds wearing down, the nickel plating can smear onto the polishing pad. Both of these conditions can lead to scratches on the wafer surface during wafer polishing, thus damaging the wafer.

Furthermore, voids in the conditioning disk (either due to manufacturing processes or the diamond fall out) can become contaminated with slurry used during the wafer polishing process. When the slurry builds up on the conditioning disk, the conditioning disk's effectiveness becomes greatly reduced. This can reduce the effectiveness of the polishing pad, and ultimately, the uniformity of the wafer.

Diamond impregnated disks also drive up the cost of the CMP process. Diamond impregnated disks are relatively expensive to purchase, have a limited lifetime, and are not re-usable.

SUMMARY OF THE INVENTION

The present invention provides a pad conditioning system and method that substantially eliminates or reduces disadvantages and problems associated with previously developed pad conditioning systems and methods More specifically, the present invention provides a system for conditioning a polishing pad in a chemical-mechanical polishing process. The conditioning system includes a conditioning device into which a plurality of removable inserts are inserted. The inserts each have a tip comprising a conditioning material. During operation, the plurality of insert tips contact the polishing pad to condition the polishing pad, thereby enhancing the uniformity of wafers polished by the polishing pad. In one embodiment, the present invention uses silicon carbide inserts with titanium nitride tips.

The present invention provides an important technical advantage by reducing or eliminating damage to the wafer. Because the present invention does not use a diamond impregnated pad conditioning disk, the wafer will not become scratched during the CMP process due to dislodged diamonds or smeared nickel plating.

The present invention provides another technical advantage by eliminating slurry build-up at the center of the pad conditioning disk. This allows the present invention to condition the polishing pad more effectively and uniformly.

The present invention provides yet another technical advantage by reducing the cost of a pad conditioning device. Diamond impregnated conditioning disks have a higher initial purchase cost and a higher replacement cost because the entire conditioning disk must be replaced rather than just replacing the inserts as in the present invention.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Preferred embodiments of the present invention are illustrated in the FIGURES like numerals being used to refer to like and corresponding parts of the various drawings.

The present invention provides a conditioning device for use in a CMP process to enhance the conditioning of the polishing pad, thereby enhancing the uniformity and planarization of the wafer after polishing. In one embodiment, the present invention uses silicon carbide inserts with coated titanium nitride tips. The removable inserts can be inserted into the conditioning device with the titanium nitride tips facing the polishing pad. In operation the tips of the inserts contact the polishing pad while the polishing pad is rotating to condition the polishing pad.

Figure 1:
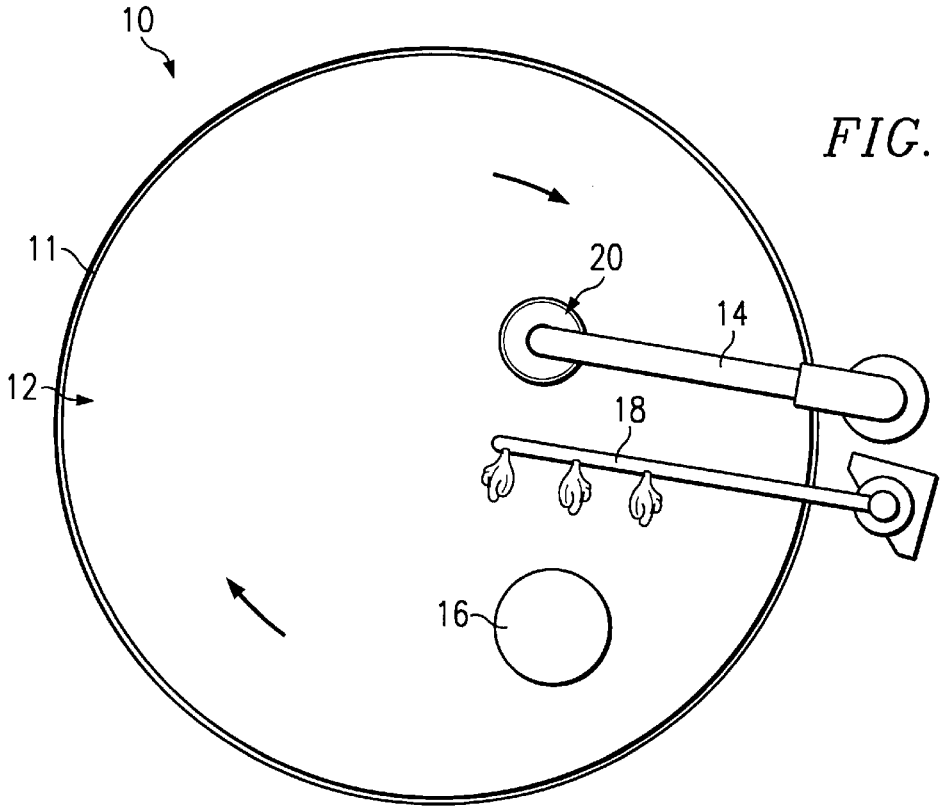
FIG. 1 shows a CMP system including an embodiment of the present invention.

FIG. 1 illustrates a CMP system 10 that includes polishing pad 12 coupled to polishing platen 11. Pad conditioner 14 includes conditioning device 20 that further includes a plurality of inserts 24 (shown in FIG. 2). During conditioning, polishing platen 11 and polishing pad 12 rotate as a unit as indicated in FIG. 1. As polishing platen 11 and conditioning pad 12 rotate, slurry applicator 18 applies a slurry to polishing pad 12. As polishing pad 12 continues to rotate, the portion of polishing pad 12 that just received slurry comes in contact with conditioning device 20. Conditioning device 20 contacts polishing pad 12 to condition polishing pad 12. The conditioned portion of polishing pad 12 then contacts a semiconductor wafer (not shown) traveling on wafer polish track 16. Polishing pad 12 then polishes the semiconductor wafer. Immediately after polishing the semiconductor wafer, the portion of polishing pad 12 having most recently contacted the semiconductor wafer again contacts conditioning device for reconditioning. The process continues as described to continue polishing wafers and conditioning the polishing pad.

Figure 2:
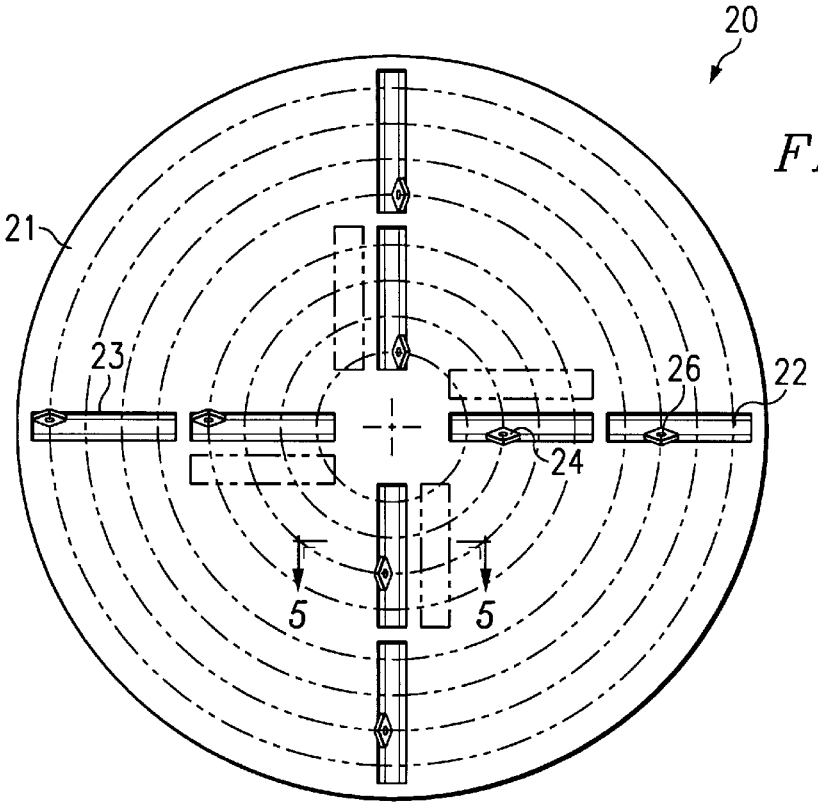
FIG. 2 shows bottom view of one embodiment of the pad conditioning device of the present invention.

FIG. 2 shows a bottom view of one embodiment of conditioning device 20 including a plurality of slots 22 formed within conditioning device 20 for receiving the plurality of inserts 24. Conditioning device 20 can be manufactured, from aluminum, 304 stainless steel, or other rigid materials. Conditioning device 20 shown in FIG. 2 has a circular shape when viewed from the top or bottom, though other shapes could be used. The diameter of conditioning device 20 can vary from approximately two inches to greater than ten inches.

Figure 4:
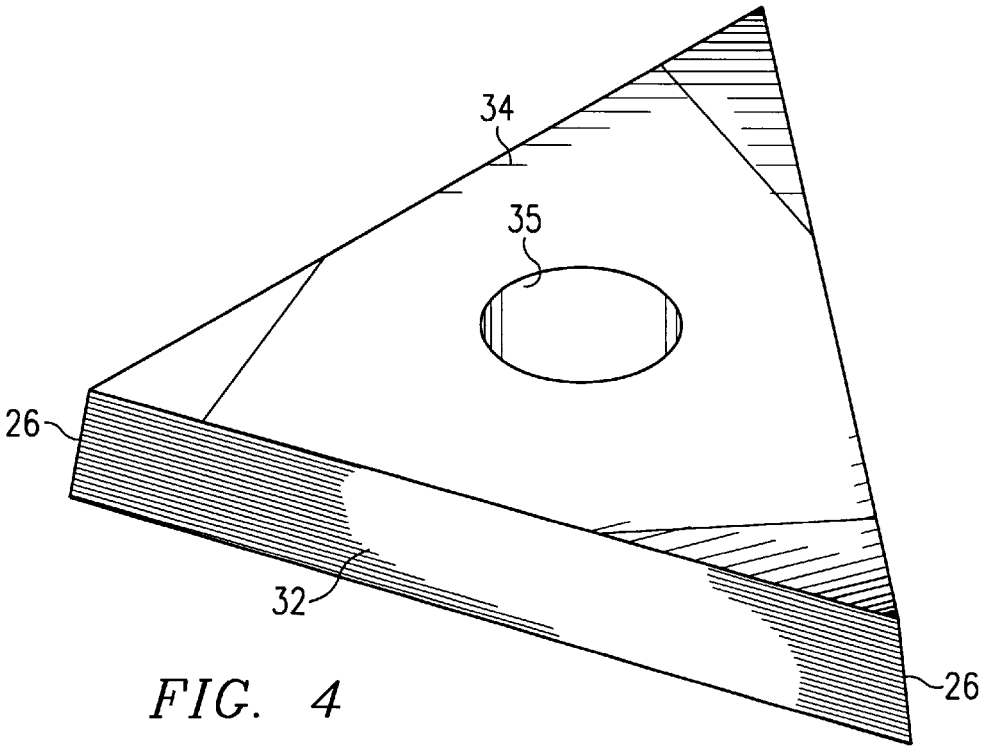
FIG. 4 shows a perspective view of another embodiment of an insert that can be used in conjunction with the present, Invention.

Inserts 24 include tips 26 manufactured from a conditioning material 32. Tips 26 can be made from silicon or tungsten carbide tips coated with titanium nitride to provide enhanced conditioning. Other materials could be used to form tip 26 for conditioning the polishing pad. Silicon carbide inserts 24 having titanium nitride tips 26 are commercially available, an example of which is T-max P Geometries manufactured by Sandvik/Coromant. Inserts 24, as shown in FIG. 4, can form a triangular shape as viewed from the side with tips 26 formed on each apex of the triangle.

FIG. 2 shows four pairs of slots 22 positioned every ninety degrees on the conditioning side 28 of conditioning device 20. Each slot 22 can contain an insert 24. As shown, each pair of slots 22 can be aligned as viewed from the outer edges of conditioning device 20 to the center of conditioning device 20. The dashed lines shown in FIG. 2 indicate an alternative formation of the slots that involves staggering slots 22 such that within each pair of slots 22 the slots do not align but are staggered from each other as viewed from the outer edge to the center of conditioning device 20. The longer edge 23 of each slot 22, whether staggered or aligned, can form an approximately right angle with the tangent of the circumference of conditioning device 20. The two alternative slot 22 arrangements shown in FIG. 2 represents uniform placement of slots 22 within conditioning device 20. Slots 22 could also be distributed randomly about the conditioning side 28 of conditioning device 20. Furthermore, while FIG. 2 shows slots 22 aligned (and staggered) in pairs, more than two slots could align (or stagger) depending on the size of conditioning device 20 and the size of inserts 24. For example, a conditioning device could have one slot 22 or three or more slots 22. The size of slots 22 and diameter of conditioning device 20 will determine the number of slots 22 used. Conditioning device 20 of FIG. 2 does not contain any slots 22 in the center area defined by an approximately one half inch diameter circle in the center of conditioning device 20.

Inserts 24 can insert into slots 22 such that tips 26 of inserts 24 are offset varying distances from the edge of the conditioning device 20, as shown in FIG. 2. Slots 22 can be machined to allow inserts 24 to be positioned at different locations within slots 22. This allows tips 26 to protrude from conditioning device 20 at varying distances from the edge of conditioning device 20.

The circular lines drawn within FIG. 2 further illustrate the offset capability of inserts 24 with respect to the edge of conditioning device 20. As shown in FIG. 2, each insert tip 26 can have be positioned within its respective slot 22 such that each insert tip 26 is located at a different distance from the edge of conditioning device 20. Positioning each tip 26 to occupy a different distance from the edge of conditioning device 20 as every other tip 26 increases the effective polishing area of the conditioning device 20.

Figure 3:
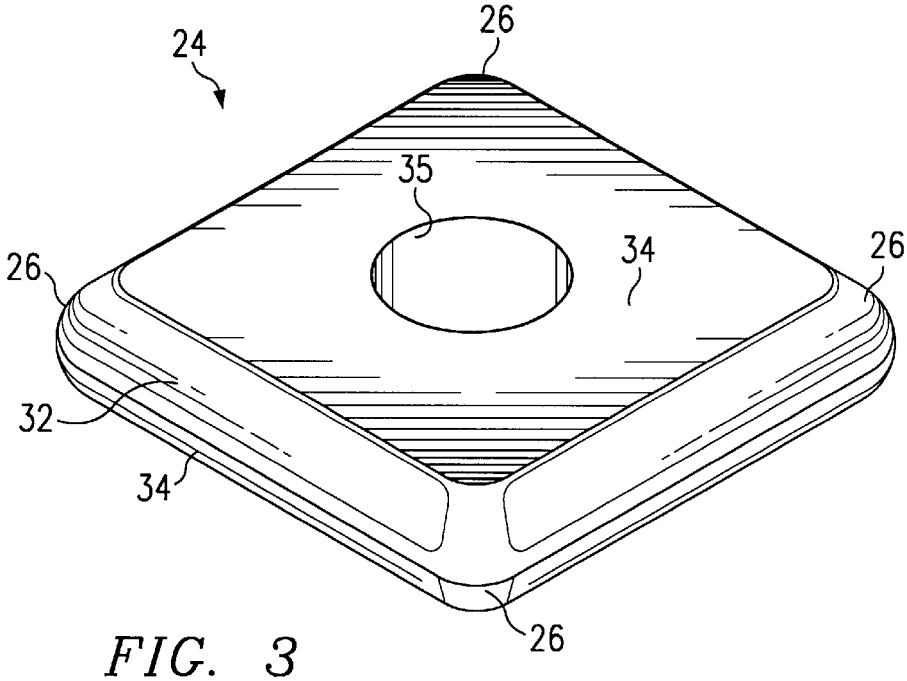
FIG. 3 shows a perspective view of one embodiment of an insert that can be used in conjunction with the present invention.

FIG. 3 shows one embodiment of insert 24 that can be used in conjunction with the present invention. FIG. 3 shows a silicon carbide insert 24 having a titanium nitride tip 26. Insert 24 shown in FIG. 3 has a generally square shape. Conditioning material 32 forms the outer surface of all four sides of the generally square shaped insert 24, including four tips 26. The conditioning material 32 coats the outer edge of main body 34 of insert 24. Main body 34 narrows towards the outermost edge to form an angle on all four sides. As shown in FIG. 3, a square shaped insert 24 provides four tips 26 that can be used to condition polishing pad 12. Other shaped inserts 24 could also be used. FIG. 4 shows a triangular insert 24 that can be used with the present invention. Triangular insert 24 includes three tips 26 made from, or coated with, a conditioning material. Conditioning material 32 of insert 24 shown in FIGS. 3 and 4 comprises titanium nitride, however, other conditioning materials could be used. For instance, a silicon carbide insert 24 without the titanium nitride coating could also be used (the conditioning material 32 being the silicon carbide itself). Insert 24 can include a threaded hole 35 for receiving a holding device such as a set screw for mounting the insert to the conditioning device 20 in slot 22. FIG. 3A shows a side view of the square shaped insert 24 including tips 26 of FIG. 3.

FIG. 4 shows insert 24 coupled to conditioning device 20 within slot 22 by means of set screw 42. Set screw 42 can thread through threaded hole 35 into threaded recess 46 formed within conditioning device 20. Slot 22 can form a recess within conditioning device 20 with an angle with respect to slot surface 21 greater or less than ninety degrees. In the embodiment shown in FIG. 4, when insert 24 mounts to conditioning device 20, insert 24 forms an angle less than ninety degrees with slot surface 21. This allows tip 26 of insert 24 to contact the polishing pad 12 at an angle less than ninety degrees to enhance the conditioning effectiveness.

During a CMP operation, polishing platen 11 and polishing pad 12 rotate as a unit as indicated in FIG. 1 with slurry applied by slurry applicator 18 to polishing pad 12. As polishing pad 12 rotates, the portion of polishing pad 12 that just received slurry comes in contact with tips 24 of conditioning device 20. The contact of tips 24 with the rotating polishing pad 12 conditions polishing pad 12 by removing a relatively small layer of polishing pad 12 in a uniform way so as to increase the planarization of polishing pad 12. The recently conditioned portion of polishing pad 12 then contacts a semiconductor wafer to polish the wafer. The rotation of polishing pad 12 continues, as does the conditioning and polishing processes. Because the tips 26 contacting the polishing pad are securely mounted (via insert 24) to conditioning device 20, there is a reduced likelihood of damaging the polishing pad 12 or wafer due to disintegration of the conditioning device 20. Tips 26 will typically wear in a uniform manner without suddenly losing large portions of material in the process. This uniform wear helps prevent damage to the wafer due to dislodging of diamonds or other conditioning materials. Conditioning devices 20 with carbide inserts 24 having titanium nitride tips 26, besides wearing more uniformly and lasting longer in operation, cost less that diamond-impregnated conditioning disks.

Without the present invention, slurry can fill the voids in the surface of conditioning device 20 (previous conditioning disks used the entire disk to perform the conditioning rather than just the insert 24 tips 26). The voids can exist in new conditioning disks from the manufacturing process, or can form in diamond-impregnated conditioning disks during operation when the diamonds fall out of the nickel plating. These slurry deposits inhibit proper conditioning of polishing pad 12 by forming a slurry layer between the polishing pad 12 and the conditioning device 20. This can significantly increase the cost of processing semiconductor wafers. Furthermore, a greater slurry build-up can occur at the center of a conditioning disk as compared to the outer edges. This can cause non-uniform conditioning and decrease planarization of the polishing pad 12 after conditioning. This can adversely affect the uniformity of the wafer after CMP processing.

The use of the present invention with inserts 24 having tips 26 that extend past slot surface 21 eliminates or greatly reduces the problem of slurry filling voids in the conditioning device 20 because the slot surface 21 does not contact the polishing pad 12. Rather, tips 26 contact the polishing pad 12 to condition the surface of polishing pad 12. Tips 26, unlike conditioning disks with the entire disk contacting the polishing pad 12, do not typically have voids to attract slurry. Thus, the slurry build-up does not typically occur. Furthermore, if a tip 26 becomes worn, the insert can be rotated to expose another tip 26 to the polishing pad 12. When all tips 26 of an insert 24 have worn down, the insert 24 is simply replaced with a new insert 24. This allows the conditioning device 20 to be re-used.

Figure 5:
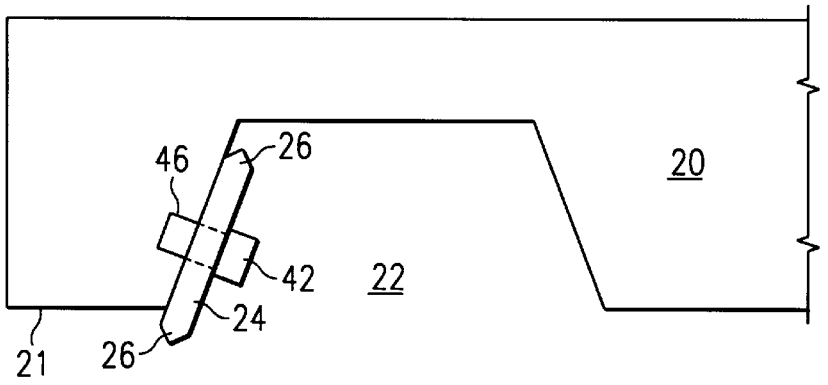
FIG. 5 shows a side view of one embodiment of the pad conditioning device of the present invention with a mounted insert.
Figure 6:
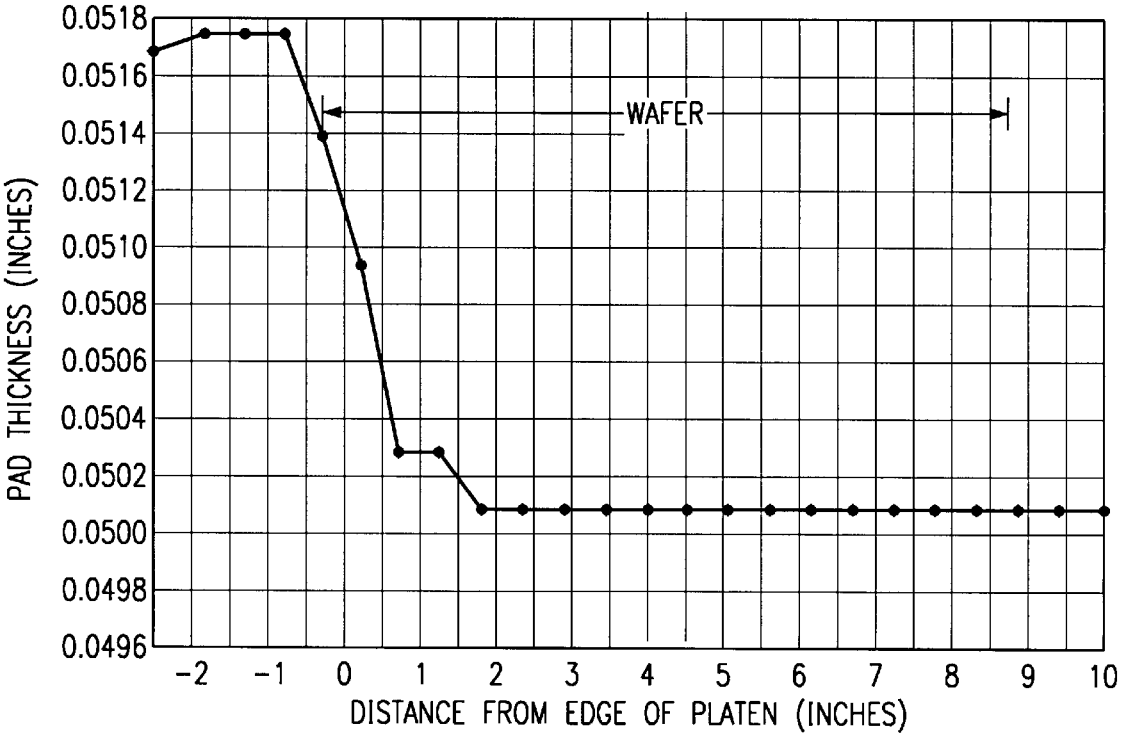
FIG. 6 is a graph illustrating the flatness of a polishing pad after conditioning with one embodiment of the present invention.

FIG. 5 shows a graph of polishing pad 12 thickness versus the distance from the edge of the platen 11. The center of polishing pad 12 is shown at eleven and one half inches on the graph of FIG. 5. The graph shows segments 0 through 10 of the polishing pad 12. Each segment forms an approximately nine tenths of an inch wide circular path around the polishing pad 12 surface. The wafer typically contacts polishing segments 1 through 9 of polishing pad 12. A flatter polishing surface on polishing pad 12 will provide better uniformity on a wafer. As shown in FIG. 5, a polishing pad 12 conditioned with an embodiment of conditioning device 20 of the present invention provides a generally uniform polishing pad surface that contacts the wafer. For the conditioned polishing pad represented by FIG. 5, the conditioning device 20 was allowed to dwell on segments 0–8 for 2.0 seconds and for segments 9–10 for 2.4 seconds. The results of the conditioning show an almost perfectly flat polishing pad surface from segments three through ten (the polishing pad 12 thickness at 0.051 inches across segments three through ten). From approximately half way through segment one through segment two, there is a 0.0002 inch step in height. The remainder of segment one rises to approximately 0.0012 above segments three through ten. This twelve thousandths rise in height over the entire polishing portion of polishing pad 12 represents an acceptably flat polishing surface that will enhance the uniformity of the polished wafer.

In summary, the present invention provides a system for conditioning a polishing pad in a chemical-mechanical polishing process. The conditioning system includes a conditioning device into which a plurality of removable inserts are inserted. The inserts each have a tip comprising a conditioning material. During operation, the plurality of insert tips contact the polishing pad to condition the polishing pad, thereby enhancing the uniformity of wafers polished by the polishing pad and reducing damage to wafers caused by previous conditioning systems.

Although the present invention has been described in detail, it should be understood that various changes, substitutions and alterations can be made hereto without departing from the spirit and scope of the invention as described by the appended claims.

What is claimed is:

1. A system for conditioning a polishing pad in a chemical-mechanical polishing process, comprising:

a conditioning device for conditioning the polishing pad, the conditioning device having a conditioning side facing the polishing pad; and a plurality of removable inserts, each insert having a tip comprising a conditioning material, the plurality of inserts inserted into the conditioning device on the conditioning side, the plurality of insert tips operable to contact the polishing pad during the chemical-mechanical polishing process to condition the polishing pad, thereby enhancing the uniformity of a wafer polished by the polishing pad wherein, the conditioning material comprises titanium nitride.

2. A system for conditioning a polishing pad in a chemical-mechanical polishing process, comprising:

a conditioning device for conditioning the polishing pad, the conditioning device having a conditioning side facing the polishing pad; and a plurality of removable inserts, each insert having a tip comprising a conditioning material, the plurality of inserts inserted into the conditioning device on the conditioning side, the plurality of insert tips operable to contact the polishing pad during the chemical-mechanical polishing process to condition the polishing pad, thereby enhancing the uniformity of a wafer polished by the polishing pad wherein, the conditioning material comprises tungsten carbide.

3. A system for conditioning a polishing pad in a chemical-mechanical polishing process, comprising:

a conditioning device for conditioning the polishing pad, the conditioning device having a conditioning side facing the polishing pad; and a plurality of removable inserts, each insert having a tip comprising a conditioning material, the plurality of inserts inserted into the conditioning device on the conditioning side, the plurality of insert tips operable to contact the polishing pad during the chemical-mechanical polishing process to condition the polishing pad, thereby enhancing the uniformity of a wafer polished by the polishing pad wherein, the removable inserts have a generally triangular shape to provide three tips, such that when a tip wears out, the insert can be removed and reinserted into the conditioning device so that another of the two tips contacts the polishing pad, thereby providing a re-usable insert that can use all three tips.

4. A system for conditioning a polishing pad in a chemical-mechanical polishing process, comprising:

a conditioning device for conditioning the polishing pad, the conditioning device having a conditioning side facing the polishing pad; and a plurality of removable inserts, each insert having a tip comprising a conditioning material, the plurality of inserts inserted into the conditioning device on the conditioning side, the plurality of insert tips operable to contact the polishing pad during the chemical-mechanical polishing process to condition the polishing pad, thereby enhancing the uniformity of a wafer polished by the polishing pad wherein, the removable inserts have a generally square shape to provide four tips, such that when a tip wears out, the insert can be removed and reinserted into the conditioning device so that another of the three tips contacts the polishing pad, thereby providing a re-usable insert that can use all four tips.

5. A system for conditioning a polishing pad in a chemical-mechanical polishing process, comprising:

a conditioning device for conditioning the polishing pad, the conditioning device having a conditioning side facing the polishing pad; and a plurality of removable inserts, each insert having a tip comprising a conditioning material, the plurality of inserts inserted into the conditioning device on the conditioning side, the plurality of insert tips operable to contact the polishing pad during the chemical-mechanical polishing process to condition the polishing pad, thereby enhancing the uniformity of a wafer polished by the polishing pad wherein, the conditioning device is circular in shape with a plurality of slots formed on the conditioning side of the conditioning device for receiving the plurality of inserts, the plurality of slots spaced approximately every 90 degrees around the circular conditioning device.

6. A system for conditioning a polishing pad in a chemical-mechanical polishing process, comprising:

a conditioning device for conditioning the polishing pad, the conditioning device having a conditioning side facing the polishing pad; and a plurality of removable inserts, each insert having a tip comprising a conditioning material, the plurality of inserts inserted into the conditioning device on the conditioning side, the plurality of insert tips operable to contact the polishing pad during the chemical-mechanical polishing process to condition the polishing pad, thereby enhancing the uniformity of a wafer polished by the polishing pad wherein, the conditioning device is circular in shape with a plurality of slots formed on the conditioning side of the conditioning device for receiving the plurality of inserts, the plurality of slots spaced approximately every 45 degrees around the conditioning device.

7. A system for conditioning a polishing pad in a chemical-mechanical polishing process, comprising:

a conditioning device for conditioning the polishing pad, the conditioning device having a conditioning side facing the polishing pad; and a plurality of removable inserts, each insert having a tip comprising a conditioning material, the plurality of inserts inserted into the conditioning device on the conditioning side, the plurality of insert tips operable to contact the polishing Pad during the chemical-mechanical polishing process to condition the polishing pad, thereby enhancing the uniformity of a wafer polished by the polishing pad wherein, the conditioning device is circular in shape with a plurality of slots formed on the conditioning side of the conditioning device for receiving the plurality of inserts, the plurality of slots in aligned pairs, each aligned pair spaced approximately every 90 degrees around the circular conditioning device.

8. A system for conditioning a polishing pad in a chemical-mechanical polishing process, comprising:

a conditioning device for conditioning the polishing pad, the conditioning device having a conditioning side facing the polishing pad; and a plurality of removable inserts, each insert having a tip comprising a conditioning material, the plurality of inserts inserted into the conditioning device on the conditioning side, the plurality of insert tips operable to contact the polishing pad during the chemical-mechanical polishing process to condition the polishing pad, thereby enhancing the uniformity of a wafer polished by the polishing pad wherein, the conditioning device is circular in shape with a plurality of slots formed on the conditioning side of the conditioning device for receiving the plurality of inserts, the plurality of slots aligned in sets of three, each set of three slots spaced approximately every 90 degrees around the circular conditioning device.

9. A system for conditioning a polishing pad in a chemical-mechanical polishing process, comprising:

a conditioning device for conditioning the polishing pad, the conditioning device having a conditioning side facing the polishing pad; and a plurality of removable inserts, each insert having a tip comprising a conditioning material, the plurality of inserts inserted into the conditioning device on the conditioning side, the plurality of insert tips operable to contact the polishing pad during the chemical-mechanical polishing process to condition the polishing pad, thereby enhancing the uniformity of a wafer polished by the polishing pad wherein, the conditioning device is circular in shape with a plurality of slots formed on the conditioning side of the conditioning device for receiving the plurality of inserts, the plurality of slots in pairs spaced approximately every 90 degrees around the circular conditioning device, each pair of slots staggered as viewed from the outer edge of the conditioning device.

10. A system for conditioning a polishing pad in a chemical-mechanical polishing process, comprising:

a conditioning device for conditioning the polishing pad, the conditioning device having a conditioning side facing the polishing pad; and a plurality of removable inserts, each insert having a tip comprising a conditioning material, the plurality of inserts inserted into the conditioning device on the conditioning side, the plurality of insert tips operable to contact the polishing pad during the chemical-mechanical polishing process to condition the polishing pad, thereby enhancing the uniformity of a wafer polished by the polishing pad wherein, the conditioning device is circular in shape with a plurality of slots formed on the conditioning side of the conditioning device for receiving the plurality of inserts, the plurality of slots in sets of three, each set of three slots spaced approximately every 90 degrees around the circular conditioning device, each set of three slots staggered as viewed from the outer edge of the conditioning device.

11. A system for conditioning a polishing pad in a chemical-mechanical polishing process, comprising:

a conditioning device for conditioning the polishing pad, the conditioning device having a conditioning side facing the polishing pad; and a plurality of removable inserts, each insert having a tip comprising a conditioning material, the plurality of inserts inserted into the conditioning device on the conditioning side, the plurality of insert tips operable to contact the polishing pad during the chemical-mechanical polishing process to condition the polishing pad, thereby enhancing the uniformity of a wafer polished by the polishing pad wherein, the conditioning device is circular in shape with a plurality of slots formed on the conditioning side of the conditioning device for receiving the plurality of inserts, the plurality of slots spaced in pairs approximately every 90 degrees around the circular conditioning device, each slot receiving an insert, each insert positioned within a slot such that each insert tip is offset from every other insert tip.

12. A method for conditioning a polishing pad in a chemical-mechanical polishing process, comprising:

rotating the polishing pad;

contacting the rotating polishing pad with a conditioning device having a plurality of inserts with tips made of a conditioning material such that the insert tips make contact with the polishing pad;

conditioning the polishing pad through the interaction of insert tips and the polishing pad, thereby enhancing the uniformity of a wafer polished by the polishing pad; and forming the insert tips from titanium nitride.

13. A method for conditioning a polishing pad in a chemical-mechanical polishing process, comprising:

rotating the polishing pad;

contacting the rotating polishing pad with a conditioning device having a plurality of inserts with tips made of a conditioning material such that the insert tips make contact with the polishing pad;

conditioning the polishing pad through the interaction of insert tips and the polishing pad, thereby enhancing the uniformity of a wafer polished by the polishing pad;

forming the inserts to have a generally triangular shape, thereby providing three tips; and removing the insert when a tip wears out; and reinserting the insert into the conditioning device such that one of the other two tips contacts the polishing pad, thereby providing a re-usable insert that can use all three tips.

14. A method for conditioning a polishing pad in a chemical-mechanical polishing process, comprising:

rotating the polishing pad;

contacting the rotating polishing pad with a conditioning device having a plurality of inserts with tips made of a conditioning material such that the insert tips make contact with the polishing pad;

conditioning the polishing pad through the interaction of insert tips and the polishing pad, thereby enhancing the uniformity of a wafer polished by the polishing pad;

forming a circular conditioning device;

forming a plurality of slots on the conditioning device for receiving the plurality of inserts; and spacing the plurality of slots approximately every 90 degrees around the circular conditioning device.

15. A method for conditioning a polishing pad in a chemical-mechanical polishing process comprising:

rotating the polishing pad;

contacting the rotating polishing pad with a conditioning device having a plurality of inserts with tips made of a conditioning material such that the insert tips make contact with the polishing pad;

conditioning the polishing Pad through the interaction of insert tips and the polishing pad, thereby enhancing the uniformity of a wafer polished by the polishing pad;

forming a circular conditioning device;

forming a plurality of slots on the conditioning device for receiving the plurality of inserts; and spacing the plurality of slots in aligned pairs around the circular conditioning device.

16. A method for conditioning a polishing pad in a chemical-mechanical polishing process, comprising:

rotating the polishing pad;

contacting the rotating polishing pad with a conditioning device having a plurality of inserts with tips made of a conditioning material such that the insert tips make contact with the polishing pad;

conditioning the polishing pad through the interaction of insert tips and the polishing pad, thereby enhancing the uniformity of a wafer polished by the polishing pad;

forming a circular conditioning device;

forming a plurality of slots on the conditioning device for receiving the plurality of inserts; and spacing the plurality of slots in staggered pairs around the circular conditioning device.

17. A method for conditioning a polishing pad in a chemical-mechanical polishing process, comprising:

rotating the polishing pad;

contacting the rotating polishing pad with a conditioning device having a plurality of inserts with tips made of a conditioning material such that the insert tips make contact with the polishing pad;

conditioning the polishing pad through the interaction of insert tips and the polishing pad, thereby enhancing the uniformity of a wafer polished by the polishing pad;

forming a circular conditioning device;

forming a plurality of slots on the conditioning device for receiving the plurality of inserts; and positioning the inserts within each slot such that the tip of each insert is offset from every other insert tip.

* * * * *